United States Patent [19]

Henderson

[11] Patent Number: 4,540,611

[45] Date of Patent: Sep. 10, 1985

[54] FOLD-UP INSULATED BEVERAGE CONTAINER HOLDER

[76] Inventor: Scott R. Henderson, 5025 Eagle Pass, Plano, Tex. 75023

[21] Appl. No.: 561,042

[22] Filed: Dec. 13, 1983

[51] Int. Cl.[3] ..... B65D 23/08

[52] U.S. Cl. ..... 428/12; D7/70; D7/77; 150/52 R; 220/85 H; 428/35

[58] Field of Search ..... D7/70, 77; 215/100.5; 220/85 H, 412; 229/1.5 B; 150/52 R; 62/530; 248/346.1; 428/12, 35, 9

[56] References Cited

U.S. PATENT DOCUMENTS

| | | | |
|---|---|---|---|
| D. 271,362 | 11/1983 | Heweston | D7/70 |
| D. 276,119 | 10/1984 | Heweston | D7/70 |
| 2,974,814 | 3/1961 | Parsons et al. | 215/100.5 X |
| 3,374,298 | 3/1968 | Studen | 428/163 X |
| 3,738,529 | 6/1973 | Rose | 220/85 H |
| 3,906,129 | 9/1975 | Damois | 428/99 |
| 4,163,374 | 8/1979 | Moore et al. | 62/457 |
| 4,183,226 | 1/1980 | Moore | 62/457 |
| 4,194,627 | 3/1980 | Christensen | 220/412 X |
| 4,372,453 | 2/1983 | Branscum | 220/412 X |
| 4,401,245 | 8/1983 | Zills | 428/100 X |
| 4,432,488 | 2/1984 | Dutcher | 428/542.8 X |

*Primary Examiner*—Henry F. Epstein
*Attorney, Agent, or Firm*—Warren H. Kintzinger

[57] ABSTRACT

A one piece beverage insulator in the form of a beverage container holder with an open top that is die cut from a sheet of insulative foam either open cell or closed cell laminated with a surface vinyl film. The one piece beverage insulator die cut pattern is in the form of two mirror image side halves joined by a center bottom shaped to conform to the bottom of a beverage container to be held by the finished holder. The die cut holder pattern is folded over on itself with the side halves aligned but with the inside foam sides of the halves facing out and the side edges are stitched or vinyl welded together after which the holder is pulled inside out through its open top returning the vinyl surface to the outside. This finished holder is stored in a collapsed flat state to be opened when receiving a beverage can or other beverage container to be held and insulated by the holder.

9 Claims, 10 Drawing Figures

FOLD-UP INSULATED BEVERAGE CONTAINER HOLDER

Figure 1:
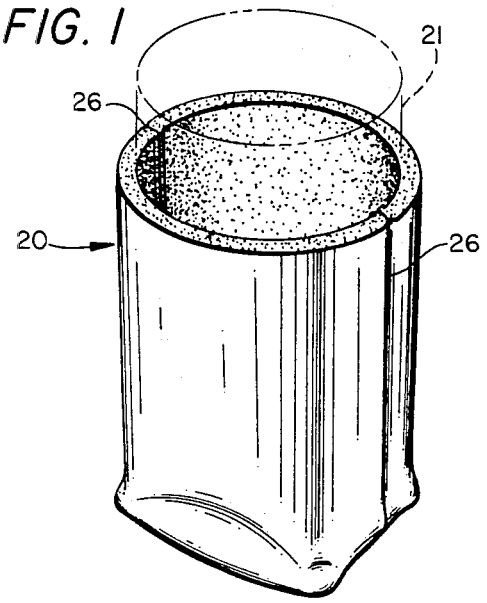

This invention relates in general to beverage insulators, and more particularly, to a fold-up insulated beverage container holder with a built in bottom with the unit collapsible to a folded flat state.

Beverage insulators come in many configurations and sizes made of many different insulative materials and many are quite expensive. Many such beverage insulators are made of relatively rigid insulative materials in the form of cup like receptacles receiving and holding beverage containers. Such beverage insulators such as stiff foamed plastic obviously can not be collapse folded as this would be destructive of the molded beverage insulator form. Wrap around beverage insulators, while good and convenient for use in many instances, require a fastening device such as Velcro in order that the insulator be adaptable to some degree of different diameter beverage containers and be reuseable time after time. Further, wrap around beverage insulators must constantly be grasped firmly on the beverage container, since, not having a bottom, a beverage container can slip through and out the bottom not only losing the drink but creating a spilled mess. The advertiser using beverage insulators as an advertising media wants the insulators to be liked by the user, as an adverse feeling with respect thereto could reflect on the advertiser.

It is therefore a principal object of this invention to provide a beverage insulator generally acceptable to the using public, easy and convenient in use and foldable to a flat convenient store state when not in use holding a beverage container.

Another object is to provide an efficient reuseable beverage insulator that is economically produced and affordable to the public.

A further object is to provide such a beverage insulator as an excellent advertising media product.

Still another object is to make the holding of beverage containers, hot or cold, more secure and safe without constantly having to firmly grasp an insulator on the beverage container being held.

Features of the invention useful in accomplishing the above objects include, in a fold-up insulated beverage container holder with a built in bottom, a one piece beverage insulator open-topped holder die cut from a sheet of insulative foam either open cell or closed cell laminated with, on at least on side, a surface vinyl film. The one piece beverage insulator die cut pattern is in the form of two mirror image side halves joined by a center bottom shaped to conform to the bottom of a beverage container being held by the finished holder. The die cut holder pattern is folded over on itself with the side halves aligned but with the inside foam sides of the halves facing out and the side edges are stitched or vinyl welded together after which the holder is pulled inside out through its open top returning the vinyl surface to the outside. This finished holder is storable in a collapsed flat state to be opened when receiving a beverage can or other beverage container to be held and insulated by the holder.

A specific embodiment representing what is presently regarded as the best mode of carrying out the invention is illustrated in the accompanying drawings.

Figure 2:
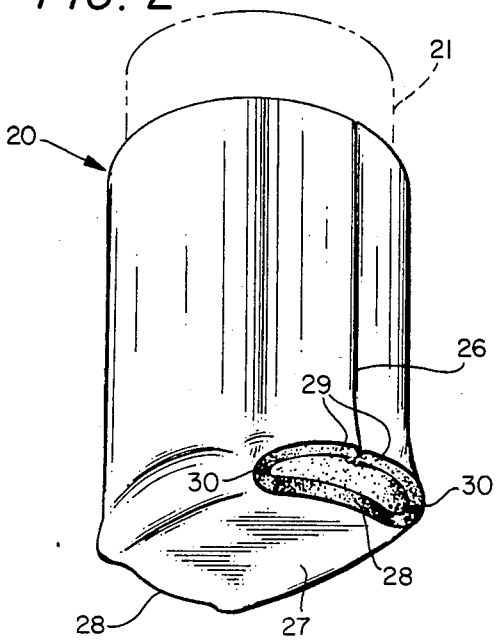
Figure 3:
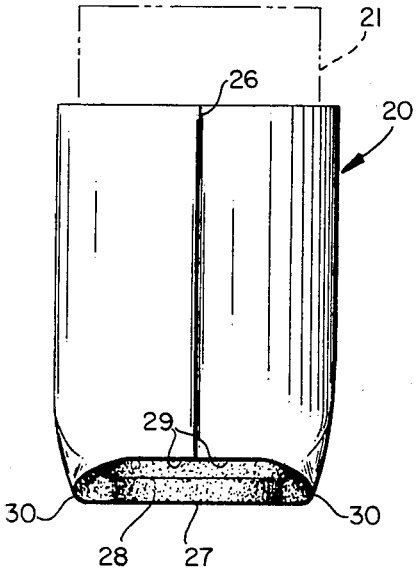
Figure 4:
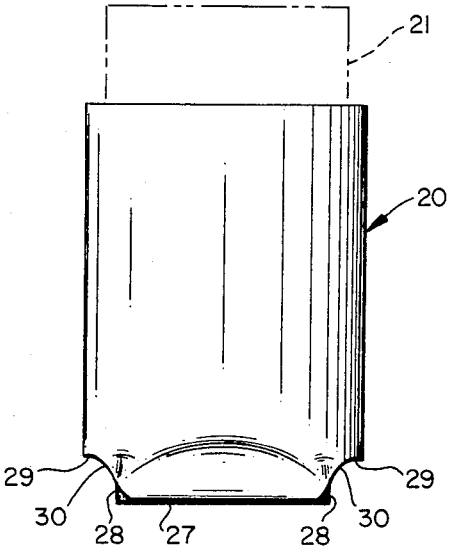
Figure 5:
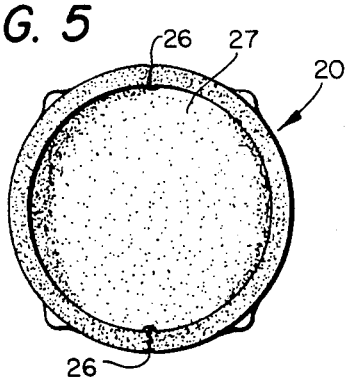
Figure 6:
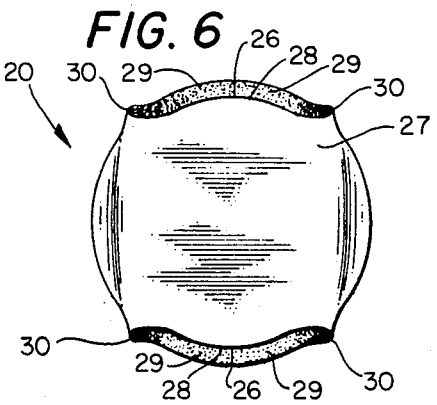
Figure 7:
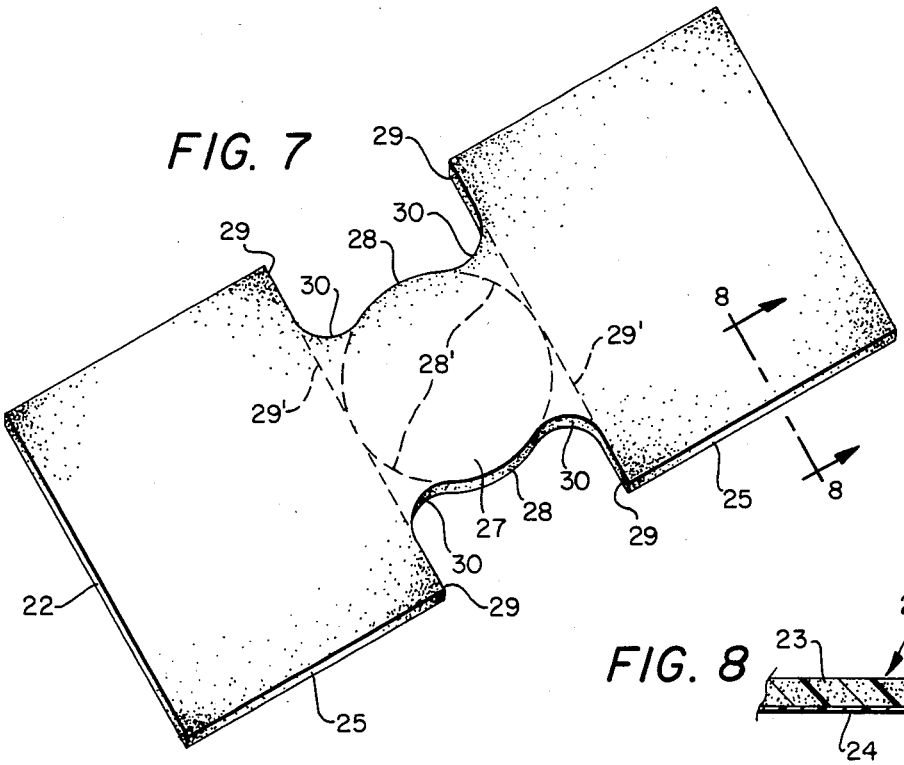
Figure 8:
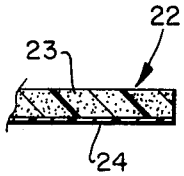
Figure 9:
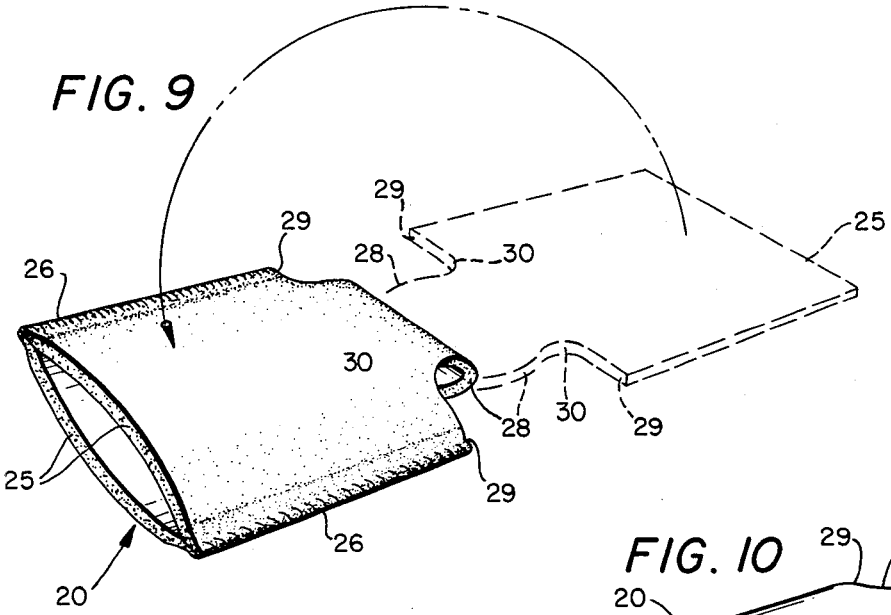
Figure 10:
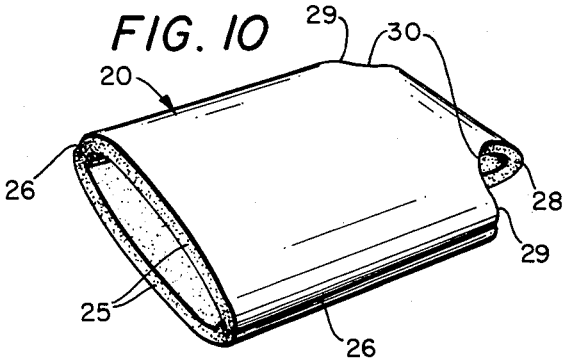

In the drawings:

FIG. 1 represents a top perspective view of the improved insulated open topped beverage container holder;

FIG. 2, a bottom perspective view thereof;

FIG. 3, a side elevation of the holder showing joined edges and the bottom from the edge;

FIG. 4, a side elevation of the holder from one side;

FIG. 5, a top plan view of the holder;

FIG. 6, a bottom plan view of the holder;

FIG. 7, a perspective view of the flat die cut sheet form of one side vinyl laminated insulative foam;

FIG. 8, a partial cut away and sectioned view of the die cut sheet form of insulative foam taken along line 8—8 of FIG. 7 showing lamination detail;

FIG. 9, a construction detail perspective view of the holder form folded over inside out with the two sides thereof internally edge stitched together; and FIG. 10, the insulative holder in the flat storage state turned outside right from the inside out state of FIG. 9.

Referring to the drawings:

The fold-up insulator 20 for holding beverage containers 21 is shown in the container 21 holding state in FIGS. 1–6. The holder 20 is made from a sheet 22 of insulative foam 23 (closed cell or open cell) with a smooth laminated outer surface vinyl 24. The holder 20 is formed from the sheet 22 with two opposite sides 25 joined together by side edge seams 26. The opposite sides 25 are also interconnected by a bottom 27 that bridges the bottoms of the sides 25 and, as shown in FIG. 7, the die cut form sheet 22 bottom 27 has opposite side edges 28 that are blended into the bottom ends 29 of opposite sides 25 by radiused fillets 30. Detail of the one sided vinyl 24 laminated insulative foam 23 sheet 22 is shown in the cut away and sectioned view of FIG. 8.

The opposite side 25 edge seams 26 are stitched with the foam sheet 22 folded over inside out as shown in FIG. 9 and the opposite sides 25 aligned. This provides two excellent vertically oriented seams 26 joining the edges of the opposite sides 25. It should be noted that heat seal welding is useable in place of stitching for producing the seams 26. In any event after the seams 26 are completed the holder 20 is pull turned outside right to the state of FIG. 10 with the smooth outer vinyl 24 laminate surface to the outside as is also the product state in FIGS. 1–6 opposite from the inside out state in FIG. 9 with the foam side of the halves facing out. The smooth outer vinyl 24 laminate surface is an excellent media for advertising.

Referring again to the die cut form sheet 22 as shown in FIG. 7 it is of interest the opposite side edges 28 between fillets 30 are arcuate and the circle projection 28' thereof if not tangent to the line projections 29' of the bottom ends 29 of opposite sides 25 is close to tangency therewith in order that the center bottom be shaped to conform to the circular bottom of a beverage container open topped holder 20 is designed to hold.

Whereas this invention has been described with respect to one embodiment thereof, it should be realized that various changes may be made without departing from the essential contributions to the art made by the teachings hereof.

I claim:

1. A fold-up insulative beverage container holder with an open top comprising: a die cut sheet form of insulative material with, two opposite side substantially rectangular halves, a center bottom interconnecting said opposite side substantially rectangular halves and with the center bottom shaped to conform to the bottom of a cylindrical beverage container the holder is designed to hold; and with edges of said opposite side substantially rectangular halves fastened together by fastening means forming two generally vertically extended seams joining said halves together forming the utilitarian insulative holder with an open top for receiving cylindrical beverage containers; wherein said die cut sheet of insulative material is a one sided smooth plastic surface laminated sheet of insulative foam with a smooth vinyl surface and with the one sided smooth plastic surface of said die cut sheet form of insulative material to the outside of said insulative beverage container holder; and wherein said sheet form of insulative material and said vinyl laminated surface in the finished holder present a soft pliable holder collapse foldable to a flat storage state from which it is readily reopenable time-after-time for repeated cycles of storage, like in a pocket, and use reopened as an insulative beverage container holder.

2. The fold-up insulative beverage container holder of claim 1, wherein said foam faces the inside of said holder and said smooth outer plastic surface is a media for printing.

3. The fold-up insulative beverage container holder of claim 1, wherein said seams have edges extending to the interior of said finished insulative beverage container holder.

4. The fold-up insulative beverage container holder of claim 3, wherein said seams are stitched seams.

5. The fold-up insulative beverage container holder of claim 3, wherein said seams are heat seal welded seams.

6. The fold-up insulative beverage container holder of claim 1, wherein said center bottom interconnecting said opposite side substantially rectangular halves has two arcuate opposite side edges connected with fillets to the bottom edges of said substantially rectangular halves.

7. The fold-up insulative beverage container holder of claim 6, wherein said center bottom is so sized that line projections of the bottom ends of opposite sides are close to tangency with a circle projection of said arcuate opposite side edges of the center bottom of the insulative holder.

8. A fold-up insulative beverage container holder comprising: a sheet form of vinyl surface laminated insulative foam material with, two opposite side substantially rectangular halves, a center bottom interconnecting said opposite side substantially rectangular halves and with the center bottom shaped to conform to the bottom of a beverage container the holder is designed to hold; and with edges of said opposite side substantially rectangular halves fastened together by fastening means forming two seams joining said halves together forming the utilitarian insulative holder with an open top for receiving cylindrical beverage containers; and wherein said sheet form of insulative material and said vinyl laminated surface in the finished holder present a soft pliable holder collapse foldable to a flat storage state from which it is readily reopenable time-after-time for repeated cycles of storage, like in a pocket, and use reopened as an insulative beverage container holder; said center bottom interconnecting said opposite side substantially rectangular halves has two actuate opposite side edges connected with fillets to the bottom edges of said substantially rectangular halves; said center bottom is so sized that line projections of the bottom ends of opposite sides are close to tangency with a circle projection of said arcuate opposite side edges of the center bottom of the insulative holder; and wherein opposite side openings between said acruate opposite side edges of said center bottom and the bottom edges of said substantially rectangular halves along with the open top facilitate collapse folding and reopening of said holder through repeated cycles of folding for storage and opening for beverage container carrying use.

9. The fold-up insulative beverage container holder of claim 8, wherein said opposite side openings are aligned with said seam to facilitate said seams to be fold lines in the fold collapse and opening of the insulative beverage container holder.

* * * * *